United States Patent [19]

Girse

[11] Patent Number: 4,674,137

[45] Date of Patent: Jun. 23, 1987

[54] MANUAL DEVICE FOR CLEANING CLOGGED DRAINS

[76] Inventor: Martin Girse, Zeisigweg 5, D-4930 Detmold, Fed. Rep. of Germany

[21] Appl. No.: 839,154

[22] Filed: Mar. 13, 1986

[30] Foreign Application Priority Data

Nov. 26, 1985 [DE] Fed. Rep. of Germany ... 8533252[U]

[51] Int. Cl.[4] ..... E03D 11/00

[52] U.S. Cl. ..... 4/255

[58] Field of Search ..... 4/255–257

[56] References Cited

U.S. PATENT DOCUMENTS

| | | | |
|---|---|---|---|
| 978,852 | 12/1910 | Cunningham | 4/255 X |
| 1,734,206 | 11/1929 | Fisch | 4/255 X |
| 2,044,594 | 6/1936 | Scholfield | 4/255 X |
| 2,129,415 | 9/1938 | Fontenot | 4/255 |
| 2,498,359 | 2/1950 | Coleman | 4/255 |
| 2,697,842 | 12/1954 | Meyer | 4/255 |
| 2,820,467 | 1/1958 | Mattich | 4/255 X |
| 3,062,152 | 11/1962 | Huff | 4/255 X |
| 4,542,543 | 9/1985 | Irwin | 4/255 |

*Primary Examiner*—Charles E. Phillips

*Attorney, Agent, or Firm*—Erwin S. Teltscher

[57] ABSTRACT

A manual device for cleaning clogged drains has a manual pump and an electric suction cup, which is mounted on the pump, and communicates with an outlet of the pump. A piston rod with a piston and controllable seals are arranged on the manual pump and together form a valve. During repeated reciprocal displacement of the piston rod, the pump may be selectively operated in a suction mode, withdrawing particles from the drain by aspiration, or in a pressure mode, blasting particles through the drain, depending on the valve adjustment. The device therefore achieves an effective cleansing of drains from clogged particles, while providing convenient handling for a user.

11 Claims, 5 Drawing Figures

MANUAL DEVICE FOR CLEANING CLOGGED DRAINS

BACKGROUND OF THE INVENTION

The present invention relates to a manual device for cleaning clogged drains.

Known manual devices of this type include a suction cup of an elastic material and a handle connected with the cup. For cleaning a clogged drain, the suction cup is placed onto the drain opening and then by moving the handle upwardly and downwardly, a suction is produced inside the suction cup and thereby the clogged matter is removed from the drain, or loosened and may be pressed through the drain.

Handling of this known manual device is complicated and it produces only a small suction force so that this device is insufficient in many cases to unclog a drain.

SUMMARY OF THE INVENTION

Accordingly, it is an object of the present invention to provide a manual device for cleaning drains, which avoids the disadvantages of the prior art.

More particularly, it is an object of the present invention to provide a manual device for cleaning clogged drains which is of a simple and inexpensive construction, is easy to handle and reliable in operation, and also provides an effective and thorough cleaning of clogged drains.

In keeping with these objects and with others which will become apparent hereinafter, one feature of the present invention resides, briefly stated, in a device for cleaning clogged drains, which has a manual pump having an outlet, and an elastic suction cup arranged on the manual pump, and operatively communicating with the outlet.

When the device is designed in accordance with the present invention, and includes the suction cup and the manual pump, a high vacuum is formed in the suction cup and thus the manual pump provides effective and neat cleaning of the drain, since by means of the high vacuum the suction cup is firmly and reliably held on the drain opening, and the clogged particles are hence withdrawn through the pump.

In accordance with another feature of the present invention, seals are arranged in the manual pump. On one hand, they serve for the formation of a vacuum, and on the other hand, they are controllable from outside, so that the manual pump can operate when pressure is exerted thereonto, for example compressed air. Thus the inventive manual device can operate in accordance with two operating modes, which can be used selectively, in dependence on the degree of clogging.

The manual device is suitable not only for cleaning of clogged wash basin drains and flush basin drains, but also for drains in toilets, bathtubs, showers and the like. Because of simple and reliable handling, the inventive manual device is of great value for any consumer.

The inventive manual device is a device of a completely new type for cleaning and eliminating even the toughest of obstructions in tubes and pipes of all kinds. By simply emplacing the device and using short pumping strokes, even the most severe pipe obstruction problem can be eliminated. Apart from the simplicity of handling and the low price, the inventive device can find wide and important utilization, and is of great benefit to the user.

It is no longer necessary to use hazardous chemicals. Each household provided with this device is enabled to make a considerable contribution to environmental protection, since each individual can thus assist in obtaining and maintaining clean brooks, streams and the seas, and consequently promote a favorable ecological equilibrium.

The novel features of the present invention are set forth in particular in the appended claims. The invention itself, however, will be best understood from the following description of the preferred embodiment which is accompanied by the appended drawings.

DESCRIPTION OF THE PREFERRED EMBODIMENT

A manual device for cleaning clogged drains in accordance with the present invention consists of a manual pump 1 and a suction cup 2 arranged on the manual pump 1. The suction cup 2 is made of an elastic material, such as rubber, synthetic plastic or the like.

Figure 1:
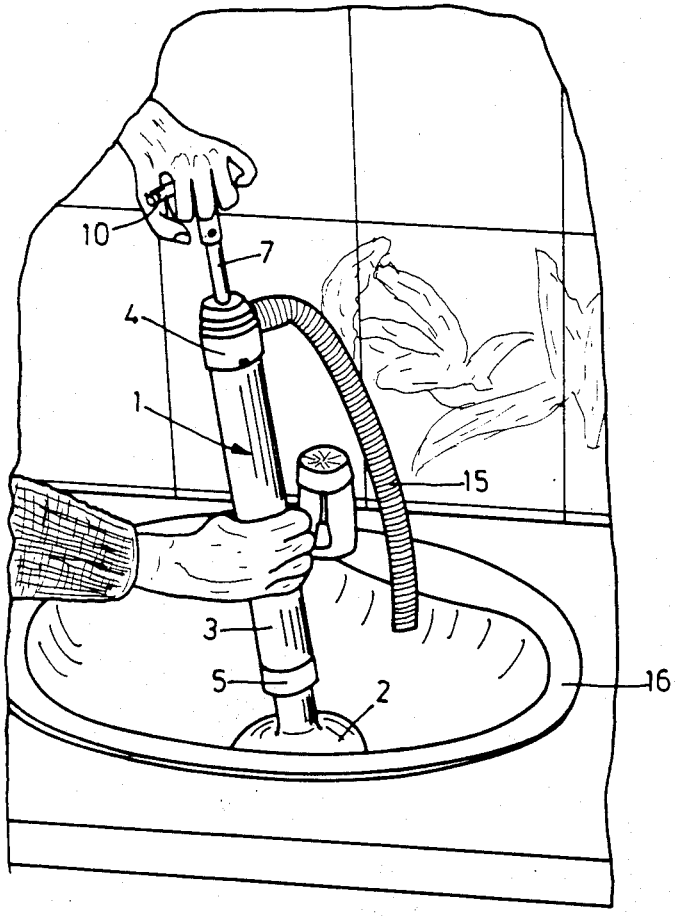
FIG. 1 is a perspective view of a manual device for cleaning clogged drains, shown during use.
Figure 2:
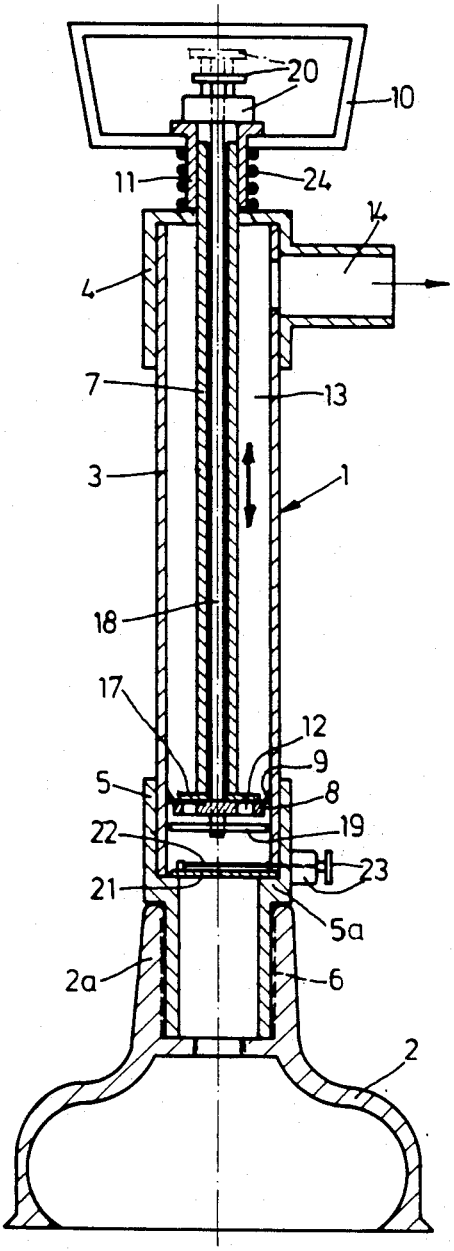
FIG. 2 is a view showing a longitudinal section of the manual device with a housing, a piston and a suction cup.

The manual pump 1 has a tubular housing 3 with a circular cross section. The housing 3 is provided at its one end (the upper end) with a hood 4, and on its other end (the lower end) with a connecting pipe 5. The hood 4 and the connecting pipe 5 are fitted onto the respective ends of the housing 3. The hood 4 may be either of a flexible type, as shown in FIG. 1, or of a rigid type, as shown in FIG. 2. The suction cup 2 is mounted on the connecting pipe 5, for example by thread means 6 (the outer thread being provided on the connecting pipe 5, and the inner thread being provided on the connecting pipe 2*a* of the suction cup 2).

A tubular piston rod 7 is displaceable in the housing 3 of the manual pump 1. The piston rod 7 has an end which faces toward the suction cup 2, and is provided at this end with a piston 8. The piston 8 has a seal 9 which surrounds its edge and abuts against the inner surface of the housing 3. The piston rod 7 has an opposite end which extends through and beyond the housing 3, and is movable therethrough without any gap being formed between the piston rod 7 and the hood 4 in a quasi-sealing manner. A handle 10 is provided on the outer end of the piston rod 7, and is connected to the piston rod 7 by means of a connecting bush 11.

The piston 8 has a plurality of through openings (holes) 12 which are arranged around the piston rod 7. When the piston rod 7 is displaced downwardly, air can flow upwardly through the through openings 12 into a chamber 13 formed between the piston rod 7 and the housing 3.

A sealing disc 17 of the flutter type is arranged on the upper side of the piston 8. It covers the through openings 12 in the piston 8. An adjusting rod 18 is arranged in the tubular piston rod 7. It extends through the piston 8 and has a lower end which projects outwardly beyond the piston 8. A sealing disc 19 of the flutter type is attached to the adjusting rod 18 at its lower end. The sealing disc 19 is matched in size to the inner cross-section of the housing 3.

The upper end of the adjusting rod 18 extends through the connecting bush 11 and is connected with upwardly and downwardly positionable closing means 20 in the form of a knob-like protrusion of the adjusting rod 18. The closing means 20 permit a longitudinal displacement of the adjusting rod 18 and thereby selective adjustment of the sealing disc 19 relative to the lower side of the piston to either a suction position or to a pressure position. The closing means is shown in FIG. 2 in full lines in the suction position, and in dotted lines in the pressure position; however, for clarity's sake the sealing disc 19 is only shown in the suction position in FIG. 2. Once set, the adjusting rod 18 always follows displacement of the piston rod 7. The piston rod 7 and the adjusting rod 18 thus form together a displaceable unit.

The connecting pipe 5 has a stepped portion 5*a*. A sealing disc 21 of the flutter type overlaps the inner cross-section of the stepped portion 5*a*. The sealing disc 21 is clamped in one edge region thereof between the housing 3 and the stepped portion 5*a*, and has another generally free opposite edge region. The sealing disc 21 is adjustable to a suction position or to a pressure position. A flexible pulling member 22 such as a wire, a synthetic plastic cord or the like is mounted on the generally free edge region of the sealing disc 21, and extends laterally outwardly beyond the housing 3. It is connected to the housing by means of a catch or lever closure member 23 provided on the housing 3.

Figure 3:
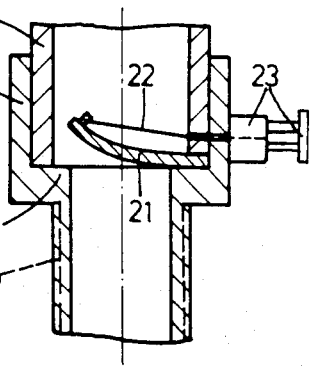
FIG. 3 is a longitudinal section of a partial region of the housing with a seal selectively adjustable to a suction position and to a pressure position.

In FIG. 2 the sealing disc 21 is located in the suction position and abuts against the stepped portion 5*a*. By means of the pulling member 22 and the arresting (catch) or lever closure 23, the sealing disc 21 can be pulled upwardly with its generally free edge region to a pressure position, in which the inner cross-section of the connecting pipe 5 is freed from abutment with the sealing disc 21, as shown in FIG. 3.

It is advantageous to arrange on a lateral outlet pipe 14 communicating with the housing 3 a flexible hose 15, which hose 15 has a length substantially corresponding to the length of the manual pump 1, and hangs downwardly in the region of the drain of a wash basin 16 or the like, so that the liquid and particles of dirt can be discharged downwardly thereof, as shown in FIG. 1.

For cleaning a clogged drain, the manual device is placed with its suction cup 2 onto the discharge opening, while the housing 3 of the manual pump 1 is held by one hand, and the handle 10 is grasped with the other hand, as shown in FIG. 1.

By reciprocally displacing the piston rod 7 upwardly and downwardly in the housing 3, the piston 8 is correspondingly displaced, and thereby a vacuum with a high suction force is formed in the suction cup 2 and in the housing 3. This leads to a reliable securement of the suction cup 2 to a region surrounding the discharge opening, and thus to an effective aspiration of the clogged matter.

Figure 5:
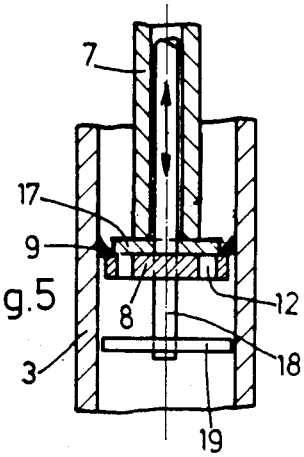
FIG. 5 is longitudinal section of a partial region of the housing with the piston corresponding to FIG. 4, but in the suction position.

During operation of the manual pump creating a partial vacuum (suction), the sealing disc 21 lies freely on the stepped portion 5*a*, so that it can flutteringly move upwardly and downwardly. The sealing disc 19 on the adjusting rod 18 is movable downwardly so as to be positioned at a spacing from the lower side of the piston as shown in FIGS. 2 and 5. Thereby the sealing disc 19 can also move flutteringly upwardly and downwardly. The upper sealing disc 17 also performs fluttering movements, however, only during downward displacement of the piston 8, since then the air in the housing 3 and in the suction cup 2 is forced to flow upwardly through the through-openings 12 in the piston 8. During displacement of the piston 8 upwardly, the sealing disc 17 abuts firmly against the lower side of the piston 8, and thus closes the through openings 12 so that thereby a vacuum is produced in the housing 3 and in the suction cup 2. The sealing disc 17 is abuttingly pushed against the upper side of the piston 8 by air located above the piston 8 in the housing 3; the air thus exerts pressure on the sealing disc 17 during upward pulling of the piston rod 7.

By means of the thus produced vacuum, which generates a full suction force after several reciprocal displacing movements of the piston rod 7, the clogged matter is pulled upwardly into the suction cup 2 and into the housing 3; when the piston 8 reaches its uppermost position the clogged matter can be discharged through the lateral outlet pipe 14.

Figure 4:
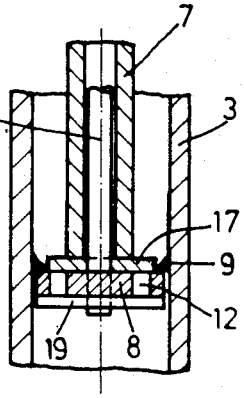
FIG. 4 is a longitudinal section of a partial region of the housing with the piston and seals arranged at each side thereof in the pressure position.

When it is desired to operate the manual device with a pressure force, the adjusting rod 18 is displaced upwardly, so that the sealing disc 19 abuts tightly against the lower side of the piston 8, as shown in FIG. 4. The sealing disc 21 is brought by the pulling member 22 to an upwardly turned release position shown in FIG. 3, so that a continuous flow through the connecting pipe 5 is assured.

During displacement of the piston rod 7 downwardly, the sealing disc 19 abutting against the piston 8 closes the through openings 12 and no air can flow upwardly through the piston 8. The air is pressed downwardly by the piston 8 and thereby compressed, so that the drain is cleaned by pressure, namely by blasting the air through the drain.

During cleaning of toilet drains, the curvature of the suction cup 2 can be reversed, so that the cup wall extends upwardly and thereby is insertable in a reliable and sealed manner into the toilet drain.

Reference numeral 24 identifies a buffer formed as springs, rubber rings or the like. It is arranged around the connecting bush 11 and during displacement of the piston rod 7 downwardly brakes the end position of the piston rod 7 in a dampening manner.

The inventive device can be used without the sealing rings 19 and 21 and without the adjusting rod 18 and the pulling member 22 with catch or lever closing means 20 and/or closure member 23. The manual device then always operates with a suction force and thereby with a partial vacuum.

The invention is not limited to the details shown, since various modifications and structural changes are possible without departing in any way from the spirit of the present invention.

What is desired to be protected by Letters Patent is set forth in the appended claims.

I claim:

1. A manual device for cleaning clogged drains, comprising in combination a manual pump having an outlet, an elastic suction cup arranged on said manual pump, and operatively communicating with said outlet, said manual pump having a tubular pump housing with a circular cross section and two ends, a hood which closes one end of said housing, and a connecting pipe which closes the other end of said tubular pump housing while overlapping a portion thereof, said suction cup being formed with a cup pipe which is threaded onto said connecting pipe of said manual pump, said connecting pipe having a stepped portion, said manual pump also having a pump housing, a sealing disc which abuts against said stepped portion of said connecting pipe, said sealing disc having one end region clamped between said housing and said stepped portion, and another edge region which is free, a pulling member connected to said other free edge region of said sealing disc, and extending laterally beyond said pump housing, and a closure member connected to said pulling member and arranged to selectively bring said sealing disc to a suction position, in which said sealing disc abuts said stepped portion, or to a pressure position in which said sealing disc is turned away from said stepped portion.

2. A manual device as defined in claim 1, wherein said pulling member is formed as a wire.

3. A manual device as defined in claim 1, wherein said pulling member is formed as a synthetic plastic cord.

4. A manual device for cleaning clogged drains, comprising in combination a manual pump having an outlet, an elastic suction cup arranged on said manual pump, and operatively communicating with said outlet, said manual pump having a pump housing having two ends, a hood which closes one end of said housing, a tubular piston rod which is displaceable in said pump housing and has two ends, a piston arranged on one end of said piston rod and having a seal with a circular edge, a plurality of through openings being formed in said seal and arranged around said piston rod, a handle provided on the other end of said piston rod and extending outwardly through said hood beyond said housing, an adjusting rod arranged in said tubular piston rod, one end of said adjusting rod extending through and beyond said piston, and another end extending beyond said pump housing, a sealing disc which is formed as a flutter type seal and is arranged on said one end of said adjusting rod, and adjustable closing means arranged on said other end of said adjusting rod so that said adjusting rod is displaceable in a longitudinal direction relative to said piston rod, and so that said sealing disc may be selectively positioned at a spacing from said piston in a suction position, where it can move flutteringly towards and away from said piston, or in a pressure position of said manual pump, where said sealing disc abuts against said piston.

5. A manual device as defined in claim 4, wherein said manual pump has a sealing disc which is formed as a flutter type seal, and is arranged at one side of said piston so as to close said through openings of said piston.

6. A manual device as defined in claim 4, wherein said manual pump has a pump housing having two ends, and further comprising attachment means for connecting said suction cup with one of said ends of said pump housing, said attachment means being formed as thread means.

7. A manual device as defined in claim 4, wherein said closing means is provided with a knob-like protrusion on the other end of said adjusting rod.

8. A manual device as defined in claim 4, wherein said knoblike protrusion may be shifted between an upper position and a lower position.

9. A manual device as defined in claim 4, wherein said adjusting rod with said sealing disc, and said closing means with said piston rod together form a single displaceable unit.

10. A manual device as defined in claim 4, wherein said manual pump has a tubular pump housing with a circular cross section and two ends, a hood which closes one end of said housing, and a connecting pipe which closes the other end of said tubular pump housing while overlapping a portion thereof, said suction cup being formed with a cup pipe which is threaded onto said connecting pipe of said hand pump.

11. A manual device as defined in claim 10, wherein said hood has an opening, said manual pump further has a lateral outlet pipe which is formed on said hood, and communicates with the interior of said housing through said opening, and a flexible hose conduit fitted onto said lateral outlet pipe.

* * * * *